US011192716B2

(12) United States Patent
McBride

(10) Patent No.: US 11,192,716 B2
(45) Date of Patent: Dec. 7, 2021

(54) WASTE BIN LINER SUPPORT MEMBERS AND RELATED METHODS OF USE

(71) Applicant: Brandon Thomas McBride, St. Albert (CA)

(72) Inventor: Brandon Thomas McBride, St. Albert (CA)

( * ) Notice: Subject to any disclaimer, the term of this patent is extended or adjusted under 35 U.S.C. 154(b) by 0 days.

(21) Appl. No.: 16/400,684

(22) Filed: May 1, 2019

(65) Prior Publication Data

US 2019/0337717 A1 Nov. 7, 2019

Related U.S. Application Data

(60) Provisional application No. 62/665,453, filed on May 1, 2018.

(51) Int. Cl.
*B65F 1/14* (2006.01)
*B65F 1/06* (2006.01)

(52) U.S. Cl.
CPC ..... *B65F 1/1415* (2013.01); *B65F 1/06* (2013.01)

(58) Field of Classification Search
CPC ..... B65F 1/1415; B65B 67/1233; B65B 67/1238; B65B 67/1227; B65D 33/02
See application file for complete search history.

(56) References Cited

U.S. PATENT DOCUMENTS 1,230,734 A * 6/1917 Lilja ..... B65B 67/12 248/99
1,736,192 A 4/1928 Easton
1,886,406 A 1/1930 Kniffin
1,836,297 A 6/1930 Vienna
2,533,524 A 12/1945 Snider
2,433,945 A 10/1946 Foreman
2,634,880 A 4/1951 Gravatt
2,757,859 A 11/1953 Holland
3,915,329 A 10/1975 Zaks
(Continued)

FOREIGN PATENT DOCUMENTS

DE 20200504899 8/2005
DE 102013015715 3/2015
(Continued)

OTHER PUBLICATIONS

Alibaba, Plastic Waste Trash Bag Clips, accessed Sep. 21, 2017, 5 pages, URL=https://www.alibaba.com/product-detail/Plastic-2Pcs-Waste-Trash-Bag-Clips_60631506004.html?spm=a2700.7724857.main07.195.70fd7169wnyC1o.
(Continued)

*Primary Examiner* — Eret C Mcnichols
(74) *Attorney, Agent, or Firm* — Robert A. Nissen

(57) ABSTRACT

An apparatus has a waste bin with a side wall defining a receptacle with a top access opening; a waste-receiving liner supported within the receptacle; and a liner support member secured to the waste bin and extending, within, and along an interior surface of, the waste-receiving liner, in a direction toward a base of the waste-receiving liner. A method includes inserting a waste-receiving liner into a receptacle of a waste bin; inserting a liner support member to extend within, and along an interior surface of, the waste-receiving liner, in a direction toward a base of the waste-receiving liner; and securing the liner support member to the waste bin.

24 Claims, 7 Drawing Sheets

(56) References Cited

U.S. PATENT DOCUMENTS

| | | | | |
|---|---|---|---|---|
| 3,927,445 | A | 12/1975 | Pavlish | |
| 4,140,257 | A | 2/1979 | Peterson | |
| 4,535,911 | A | 8/1985 | Goulter | |
| 4,628,007 | A | 12/1986 | Ledsham | |
| 4,834,260 | A | 4/1989 | Auten | |
| 4,842,228 | A | 6/1989 | Kasper | |
| 4,878,592 | A | 11/1989 | Lee | |
| 4,974,746 | A | 12/1990 | Dickinson | |
| 4,997,149 | A * | 3/1991 | Koch | B65F 1/06 220/495.06 |
| 5,222,704 | A * | 6/1993 | Light | B65F 1/06 220/495.08 |
| 5,314,151 | A * | 5/1994 | Carter-Mann | B65B 67/1227 248/100 |
| 5,518,136 | A | 4/1996 | Muldner | |
| 5,735,495 | A | 4/1998 | Kubota | |
| 5,806,416 | A * | 9/1998 | Cerniglia | B30B 1/30 100/229 A |
| 5,881,975 | A * | 3/1999 | Bianco | B65B 67/1227 248/95 |
| 5,915,584 | A * | 6/1999 | Sposit | B65B 67/1227 220/495.09 |
| 6,044,877 | A | 4/2000 | Bennet | |
| 6,109,002 | A | 8/2000 | McCabe | |
| 6,155,521 | A | 12/2000 | O'Hanlon | |
| 6,176,455 | B1 | 1/2001 | Ma | |
| 6,367,822 | B1 | 4/2002 | Hutchins | |
| 6,860,094 | B1 * | 3/2005 | Abrams | B65F 1/1405 100/246 |
| 7,255,242 | B2 | 8/2007 | Shalit | |
| 7,401,708 | B2 | 7/2008 | Lin | |
| 7,591,060 | B2 | 9/2009 | Shalit | |
| 8,181,919 | B1 * | 5/2012 | Blum | B65B 67/1233 248/97 |
| 8,240,621 | B1 * | 8/2012 | Singh | B65D 25/16 248/99 |
| 8,292,114 | B1 * | 10/2012 | Tabele, Jr. | B65F 1/06 220/495.08 |
| 8,834,023 | B1 | 9/2014 | Laera | |
| D767,640 | S * | 9/2016 | Major | B65F 1/1405 D15/17 |
| 10,207,864 | B2 * | 2/2019 | McBride | B65F 1/067 |
| 10,435,237 | B1 * | 10/2019 | Schmeck | B65F 1/1415 |
| 2003/0098309 | A1 * | 5/2003 | Liao | B65F 1/1415 220/495.09 |
| 2005/0199632 | A1 | 9/2005 | Anderson | |
| 2006/0010659 | A1 | 1/2006 | Penn | |
| 2008/0006638 | A1 | 1/2008 | Yang | |
| 2009/0041392 | A1 | 2/2009 | Turner | |
| 2013/0186900 | A1 | 7/2013 | Heintzman | |
| 2019/0256283 | A1 * | 8/2019 | Moore | B65F 1/1415 |

FOREIGN PATENT DOCUMENTS

| | | |
|---|---|---|
| EP | 1172307 | 7/2001 |
| GB | 191328379 | 10/1914 |
| GB | 2474874 | 4/2011 |
| KR | 20030029741 | 4/2003 |
| KR | 200434947 | 12/2006 |
| WO | 2012101291 | 8/2012 |

OTHER PUBLICATIONS

Lalema, Recycling liner for resin step-on container, accessed Aug. 1, 2018, 3 pages, URL=https://www.lalema.com/product/recycling-liner-resin-step-on-containers-eight-gallons-20448.

Grandinroad, Teak waste bin with liner, accessed Aug. 1, 2018, 3 pages, URL=https://www.grandinroad.com/teak-waste-bin-with-liner/home-care-pets/home-organization-storage/611596?cm_mmc=pinterest-_-pingage-_-1760106.

Lumberjocks, Thien baffle on the fly project #6, accessed Jun. 4, 2019 and available as early as May 29, 2014, 5 pages, URL=https://www.lumberjocks.com/Holbs/blog/41277.

* cited by examiner

WASTE BIN LINER SUPPORT MEMBERS AND RELATED METHODS OF USE

TECHNICAL FIELD

This document relates to liner support members for waste bins, as well as related methods of use.

BACKGROUND

Devices are known that retain a garbage bag in an open configuration within a garbage bin or support structure. Some of these devices include a sheet that curls up and applies pressure in an outward direction against a garbage bag to open the bag.

SUMMARY

An apparatus is disclosed comprising: a waste bin with a side wall defining a receptacle with a top access opening; a waste-receiving liner supported within the receptacle; and a liner support member secured to the waste bin and extending, within, and along an interior surface of, the waste-receiving liner, in a direction toward a base of the waste-receiving liner.

A method comprising: inserting a waste-receiving liner into a receptacle of a waste bin; inserting a liner support member to extend within, and along an interior surface of, the waste-receiving liner, in a direction toward a base of the waste-receiving liner; and securing the liner support member to the waste bin.

A kit of parts suitable to retrofit a waste bin and secure a liner within the bin is also disclosed.

Clips are disclosed that are adapted to attach to a rim of a waste bin, with the clips sitting on opposite sides of the rim, and with the clips cooperating to mount a flexible strip that extends from one clip down into the bin and back out in an arcuate shape to the other clip to contact and support the interior of a garbage bag so the waste bin can be overturned and emptied without removing the garbage bag.

In various embodiments, there may be included any one or more of the following features: The liner support member extends along the interior surface of the waste-receiving liner from a first side of the side wall, along a base of the waste-receiving liner, and up a second side of the side wall in a direction toward the top access opening. The liner support member is secured to the first side of the side wall at or near the top access opening of the waste bin. The liner support member is secured to the second side of the side wall at or near the top access opening of the waste bin. The first side and the second side are diametrically opposed to one another. The liner support member is resilient. The waste-receiving liner is a flexible bag, and the liner support member one or more of a) presses in outward directions against the interior surface of the waste-receiving liner and b) forms an arcuate shape. The liner support member conforms the waste-receiving liner to an interior shape of the receptacle. The liner support member comprises an elongate strip. The liner support member is secured to the waste bin by being secured to the side wall at a position at or adjacent the top access opening. The liner support member is secured to the waste bin using a hook part that connects to a perimeter rim, which defines the top access opening, of the waste bin. A plurality of hook parts, with one hook part securing a first part of the liner support member to a first side of the side wall, and a second hook part securing a second part of the liner support member to a second side of the side wall. A plurality of liner support members crossing one another within the waste-receiving liner, with each liner support member secured to the waste bin via a respective plurality of hook parts. The hook part extends in sequence from the receptacle, over and under the perimeter rim of the waste bin. The hook part connects to the top perimeter rim by a respective hinge. The hook part comprises a peg, which engages the waste-receiving liner to support the waste-receiving liner. A cap, which engages the peg to sandwich the waste-receiving liner between the cap and the peg. The liner support member is secured to the waste bin by being secured to the cap. The liner support member is secured to the waste bin in a fashion that permits axial length adjustment of a portion of the liner support member that extends along the interior surface of the waste-receiving liner. The liner support member comprises a plurality of stops that are axially spaced from one another along the liner support member. The liner support member is secured to the waste bin by a gripper part that contacts a selected stop of the plurality of stops to set an axial length of the portion of the liner support member. A liner rim support member that is secured to the waste bin and extends, along the interior surface of the waste-receiving liner, in a circumferential direction at or adjacent the top access opening. The liner rim support member is secured to the waste bin by being secured to a part that engages the waste-receiving liner. The liner rim support member or a plurality of liner rim support members extend around the entirety of a perimeter of the waste-receiving liner at or adjacent the top access opening. The liner rim support member is secured to the waste bin in a fashion that permits axial length adjustment of a portion of the liner rim support member that extends along the interior surface of the waste-receiving liner. The liner rim support member comprises a plurality of stops that are axially spaced from one another along the liner rim support member. The liner rim support member is secured to the waste bin by a gripper part that contacts a selected stop of the plurality of stops to set an axial length of the portion of the liner rim support member. The strip may have a plurality of spacers at one end, and the clip is adapted to engage the strip at any of a variety of sections adjacent respective spacers in order tailor the length of the strip between the clips. The clips may be adapted to cooperate to mount a second strip that extents from one clip circumferentially around the inside of the rim to the other clip to support a corresponding rim of the garbage bag in use. Each clip may have a peg on an inside-facing surface to engage and mount the garbage bag, with or without a cap that mounts the strip and is adapted to a) engage the peg to secure the garbage bag on the peg and b) mount the strip within the garbage bag. Each clip may have a handle that swings down in use to engage the rim of the waste bin, with the handle having a tiered inside-facing surface that is adapted to engage and secure a plurality of different waste bin rims of different respective thicknesses.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

3 and 4 two clip embodiments are shown on the left and right side of the figure, with a dashed line used to separate the embodiments.

Figure 7:
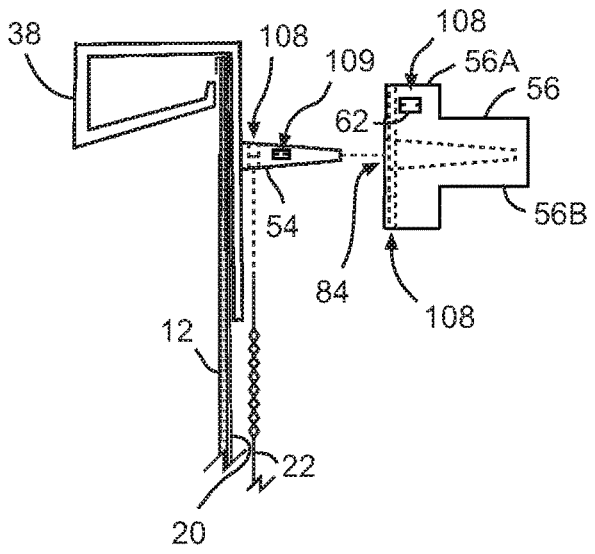
Figure 8:
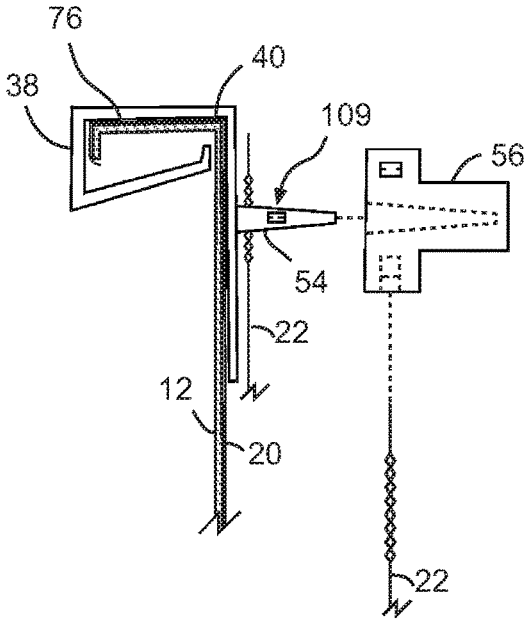

FIGS. 7-8 are side elevation cross-sectional partially exploded views of different embodiments of a combination of a rim portion of a waste bin, mounting a waste-receiving liner, a hook part, a cap, and one or more liner support member.

Figure 9:
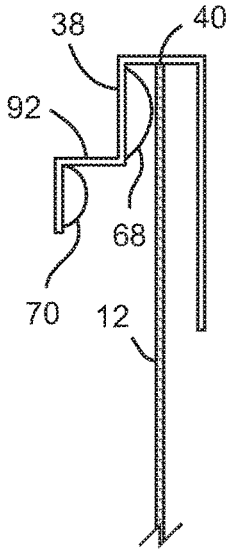
Figure 10:
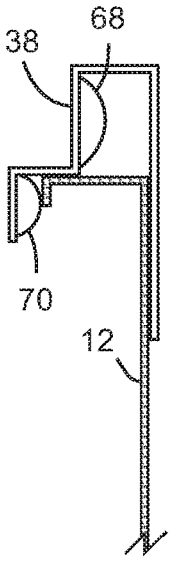

FIGS. 9-10 are side elevation cross-sectional views of rim portions of different embodiments of a combination of a waste bin and a hook part.

Figure 11:
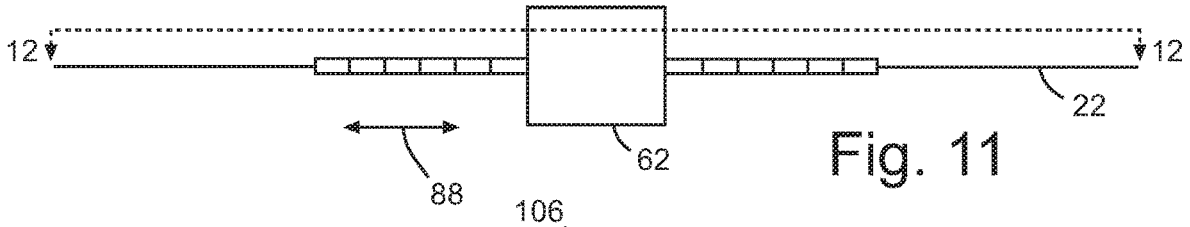

FIG. 11 is a side elevation view of a liner support member for a waste bin, in combination with a part for gripping the liner support member at different points along the member.

Figure 12:
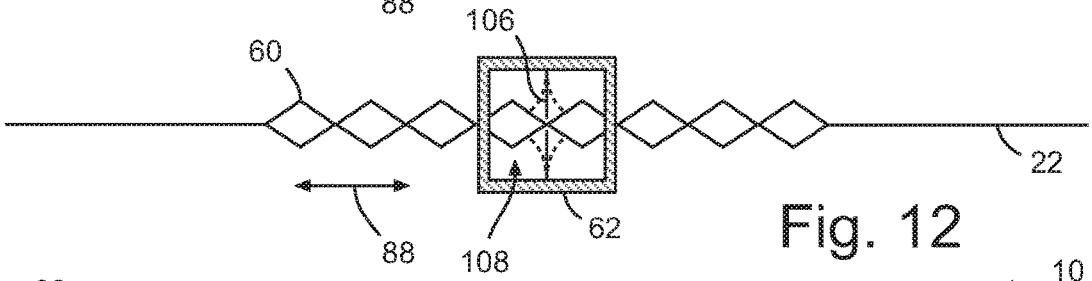

FIG. 12 is a section view taken along the 12-12 section lines from FIG. 11.

Figure 13:
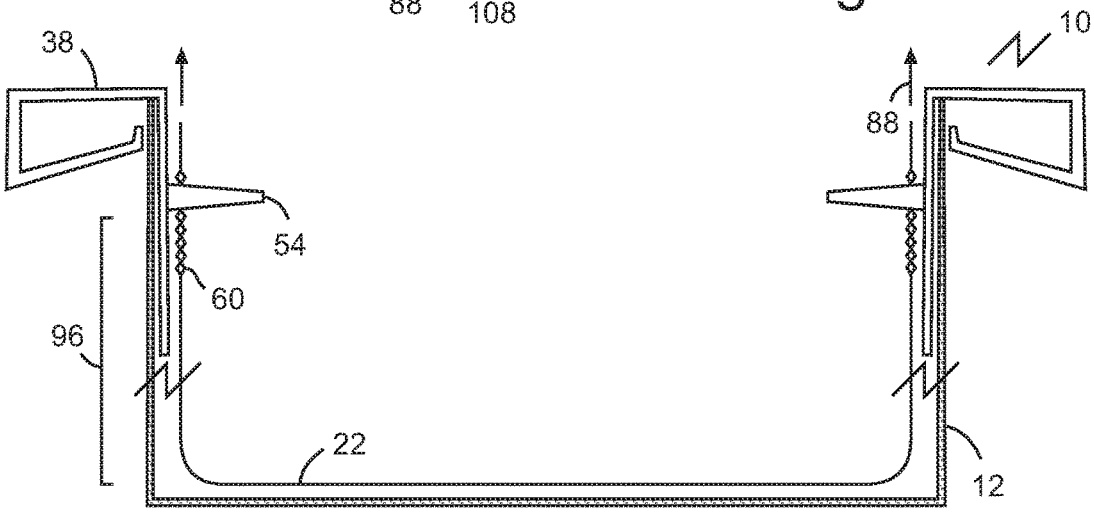
Figure 13A:
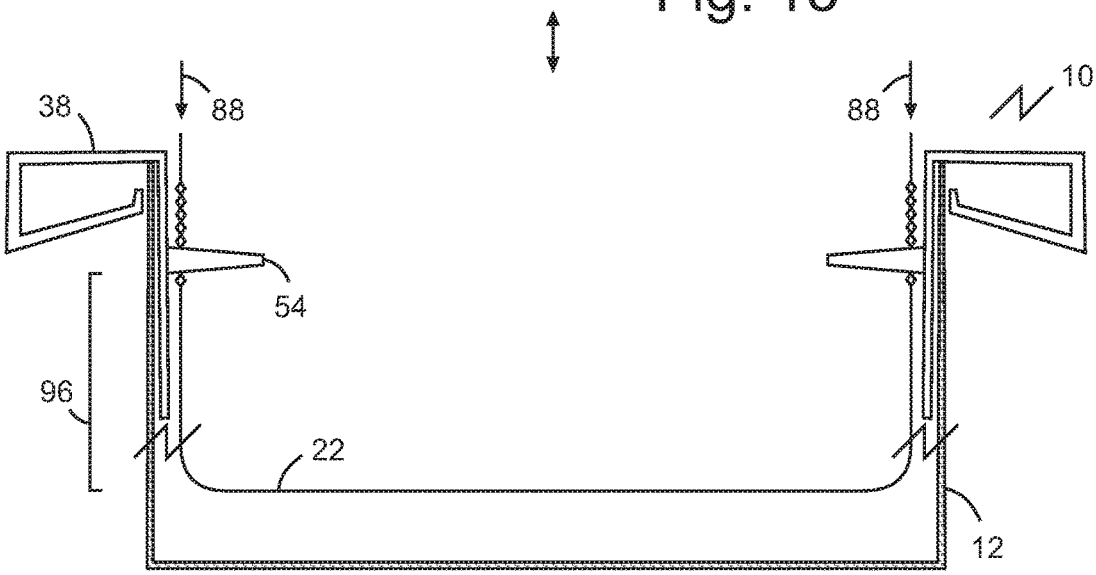

FIGS. 13 and 13A are a series of side elevation cross-sectional views of an embodiment of an assembly of hook parts connected to the rim of a waste bin with a liner support member secured between the two hook parts. For the purpose of illustration the liner itself is not shown, but the two figures each illustrate the liner support member adjusted to different lengths to accommodate liners of different dimensions within the waste bin.

FIGS. 14-19 are side elevation cross-sectional views of different embodiments of an assembly of a waste bin, a liner, liner clips, and liner support member.

Figure 20:
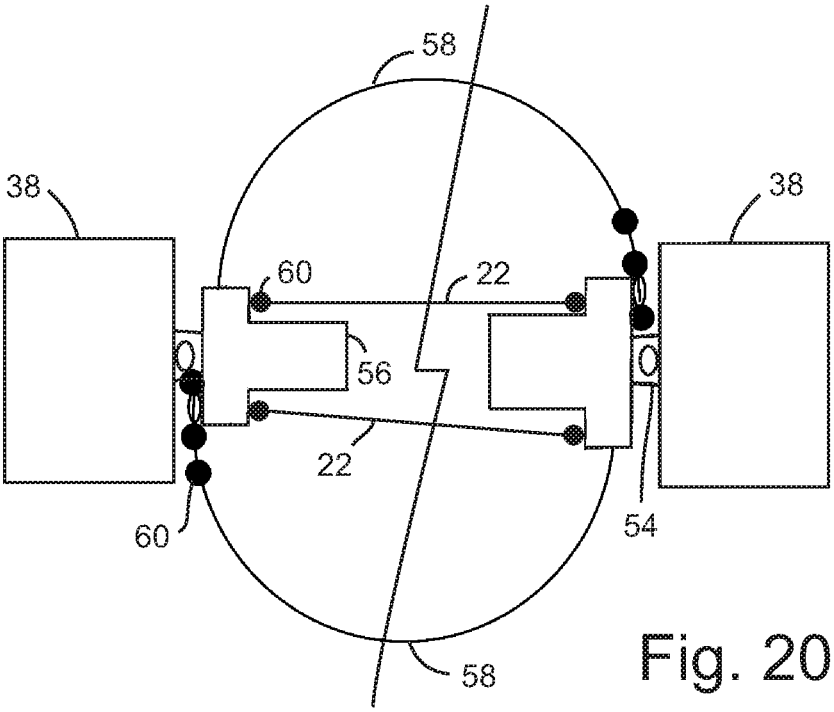

FIG. 20 is a top plan view of an assembly of two hook parts, two caps, two liner support members, and two liner rim support members.

Figure 21:
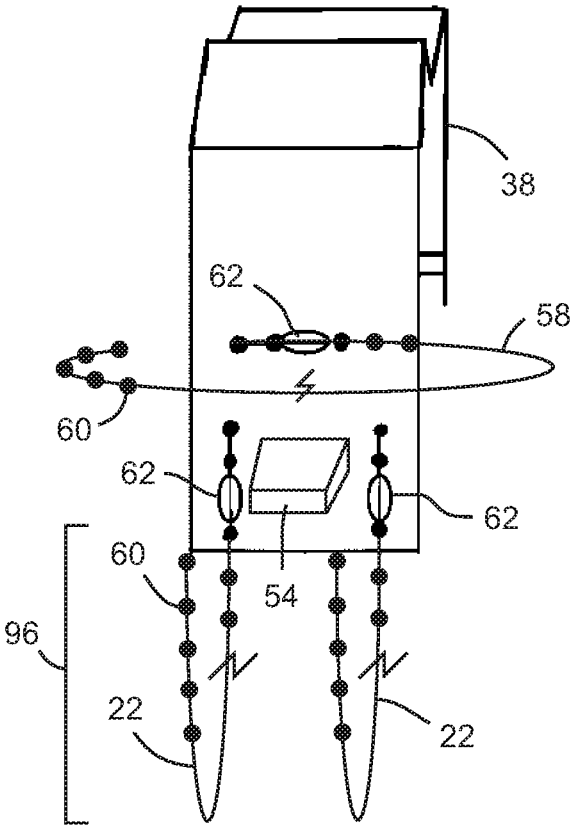

FIG. 21 is a perspective view of a hook part, two liner support members, and a liner rim support member.

Figure 22:
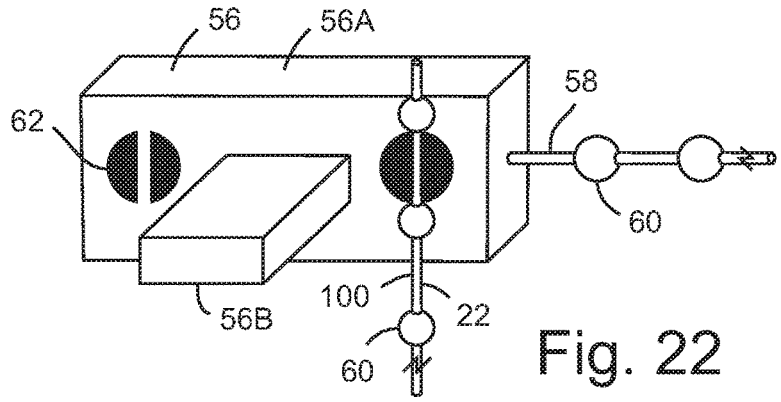

FIG. 22 is a perspective view of a cap, a liner support member, and a liner rim support member.

Figure 23:
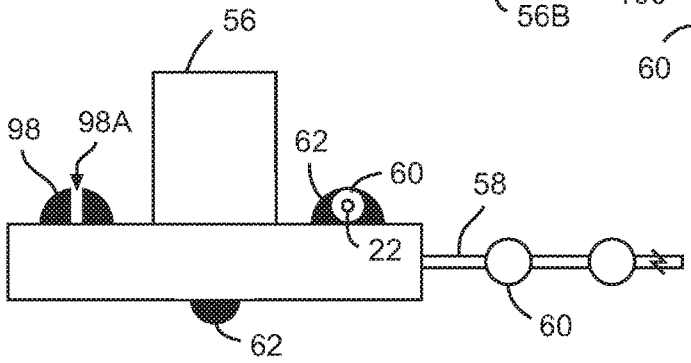

FIG. 23 is a bottom plan view of the cap, the liner support member, and the liner rim support member of FIG. 22.

Figure 24:
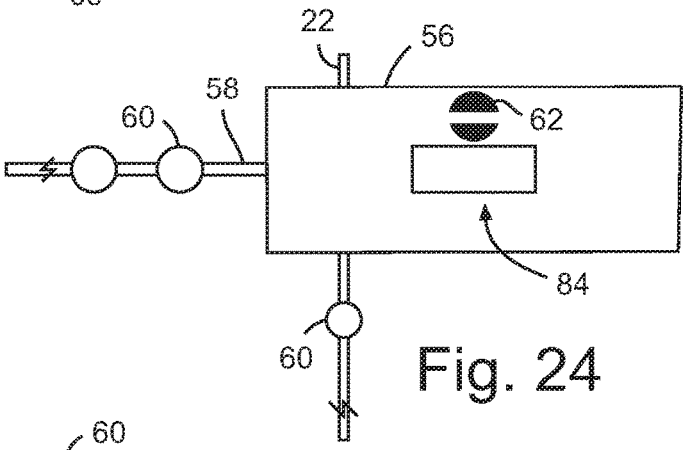

FIG. 24 is an end elevation view of the cap, the liner support member, and the liner rim support member of FIG. 22.

Figure 25:
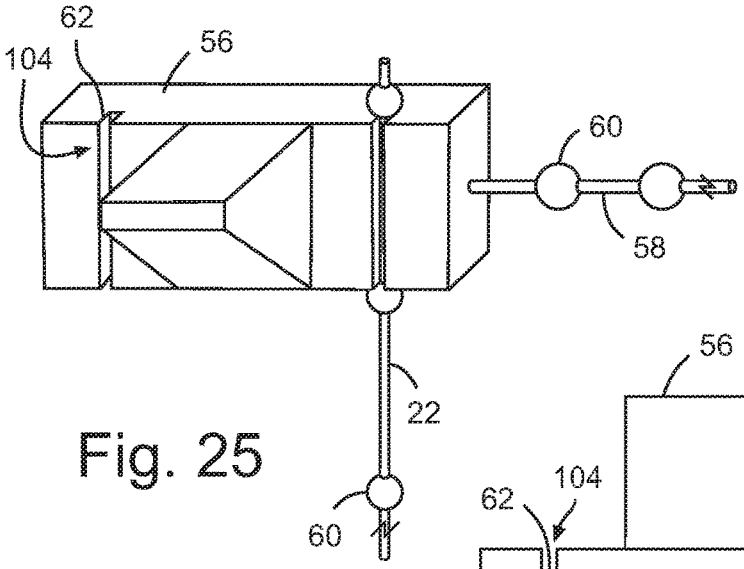

FIG. 25 is a perspective view of a cap, a liner support member, and a liner rim support member.

Figure 26:
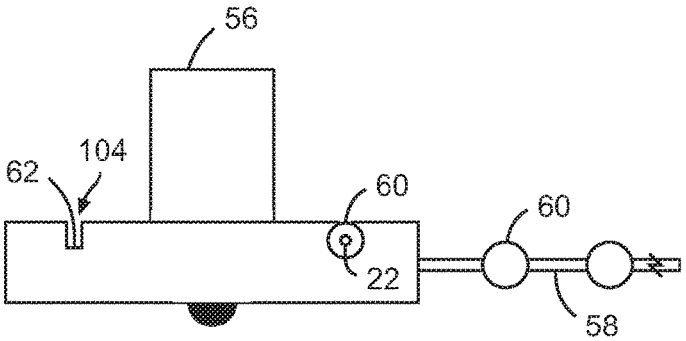

FIG. 26 is a bottom plan view of the cap, the liner support member, and the liner rim support member of FIG. 25.

Figure 27:
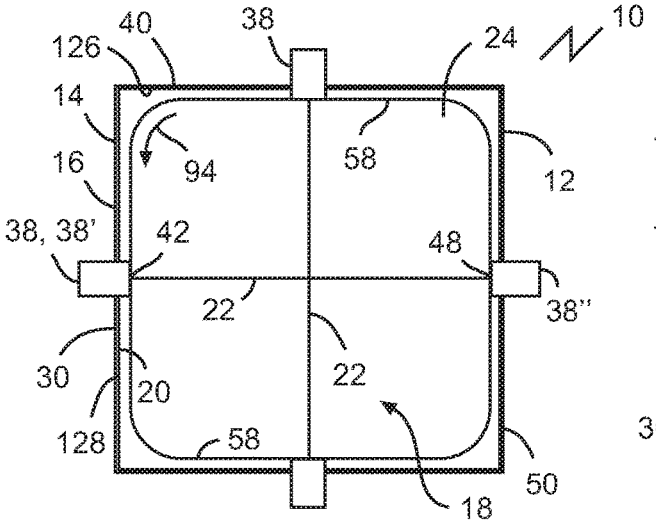

FIG. 27 is a top plan view of another embodiment of an apparatus for storing and disposing of waste, the embodiment including a waste bin, four hook parts, several liner rim support members spanning the inner periphery of the waste bin, two liner support members, and a liner.

Figure 28:
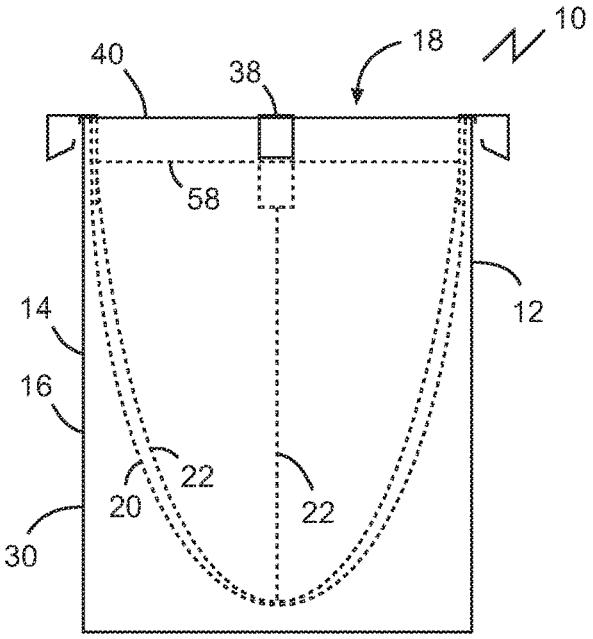

FIG. 28 is a side elevation view of the apparatus of FIG. 27.

Figure 29:
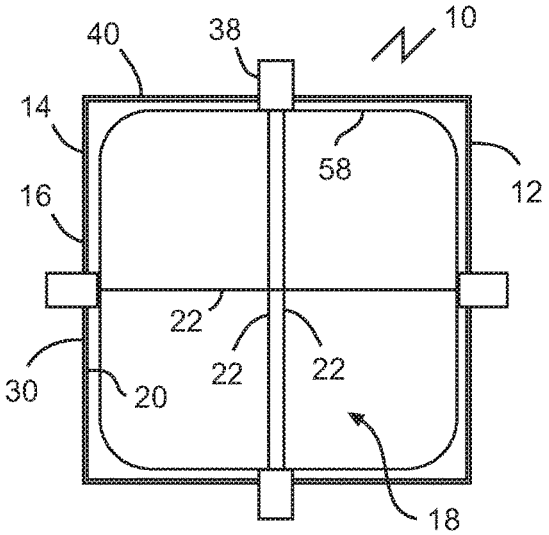
Figure 30:
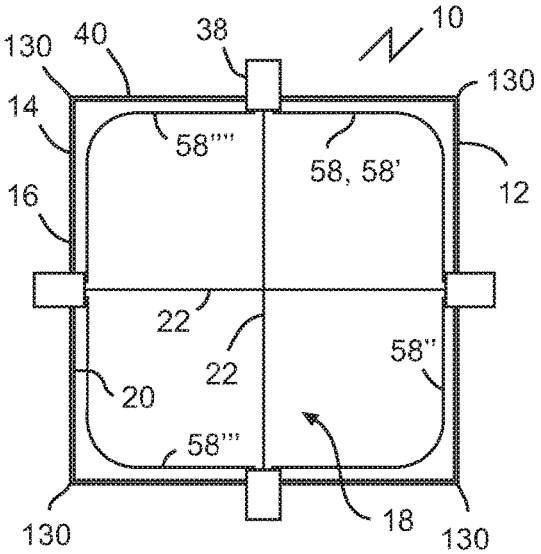

FIGS. 29-30 are top plan views of two different embodiment of an apparatus for storing and disposing of waste, the embodiment including a waste bin, four hook parts, several liner rim support members spanning the inner periphery of the waste bin, liner support members (three in FIG. 29, two in FIG. 30), and a liner.

DETAILED DESCRIPTION

Immaterial modifications may be made to the embodiments described here without departing from what is covered by the claims. In many of the figures, various parts are illustrated as being separated from others for the purpose of indicating that such components are independent of adjacent parts, however, in use such parts would contact one another.

Waste bins are used to store waste for a period of time prior to being transported to a disposal, processing, or recycling facility. Many local authorities distribute standardized waste bins for accumulating waste for curb side pickup. During use waste bins tend to get soiled, which may occur as a result of continual direct contact with waste if no flexible bag liner is used to protect the waste bin, or from indirect or occasional contact with waste that leaks or falls from a flexible bag liner within the waste bin. A soiled waste bin may harbor various pathogens and toxic materials, thus presenting a sanitary hazard. In addition, a soiled waste bin may release noxious odors every time a lid is removed to access the interior of the waste bin. Waste bins tend to be large, rugged, reusable items that are difficult to clean and expensive to replace.

Disposable bags may be used to line the insides of waste containers to prevent the insides of the containers from becoming coated in waste material, and to streamline transfer of waste between bin and garbage truck. Such bags may be made of plastic or other suitable flexible material. Plastic bags are lightweight and useful for holding both dry and messy or wet rubbish such as food waste. Such bags serve improve sanitation by minimizing container contact with garbage. After a bag in a container is filled, the bag can be pulled out, closed, and tied with minimal container contact with the waste matter.

Figure 1:
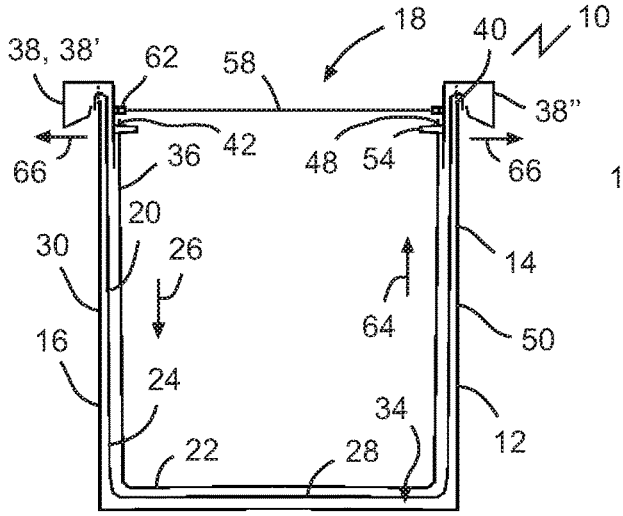
FIGS. 1-6 are side elevation cross-sectional views of different embodiments of an assembly of a waste bin, a liner, liner clips, a liner support member, and in the case of FIGS. 3-6, caps for securing the liner to the clips. In each of FIGS.

Referring to FIG. 1, an apparatus 10 is illustrated comprising a waste bin 12, a waste-receiving liner 20, and a liner support member 22. The waste bin 12 may have a side wall 14, for example that defines a receptacle 16. The receptacle 16 may have a top access opening 18, for example configured to receive the waste-receiving liner 20 and the liner support member 22. The waste-receiving liner 20 may be inserted into and/or supported within the receptacle 16. The liner support member 22 may be inserted into and/or secured to the waste bin in a suitable configuration. The liner support member 22 may extend within, and along an interior surface 24 of, the waste-receiving liner 20, for example in a direction 26 toward a base 28 of the waste-receiving liner 20. The waste-receiving liner 20 may be a flexible bag or other part suitable for receiving waste.

Referring to FIG. 1, the liner support member 22 may have a suitable configuration. The liner support member 22 may extend along, for example in contact with, the interior surface 24 of the waste-receiving liner 20 from a first side 30 of the side wall 14, along the base 28 of the waste-receiving liner 20, and up a second side 50 of the side wall 14, for example in a direction 64 toward the top access opening 18. The first side 30 and the second side 50 may be diametrically opposed to one another or positioned at other suitable locations relative to one another. The configuration of the liner support member 22 may maintain the waste-receiving liner 20 in an open position, for example to facilitate entry of waste into the waste-receiving liner 20 without direct contact of such waste with the waste bin 12. After the waste-receiving liner 20 is filled with waste, the waste-receiving liner 20 may be emptied by turning the apparatus 10 upside down. The configuration of the liner support member 22 may retain the waste-receiving liner 20 within the waste bin 12 when the apparatus 10 is in an upside down or inverted position. After the waste-receiving liner 20 has been emptied, the configuration of the liner support member 22 may permit reuse of the waste-receiving liner 20, for example without the need to remove any one or more of the waste-receiving liner 20 and the liner support member 22 from the waste bin 12.

Figure 14:
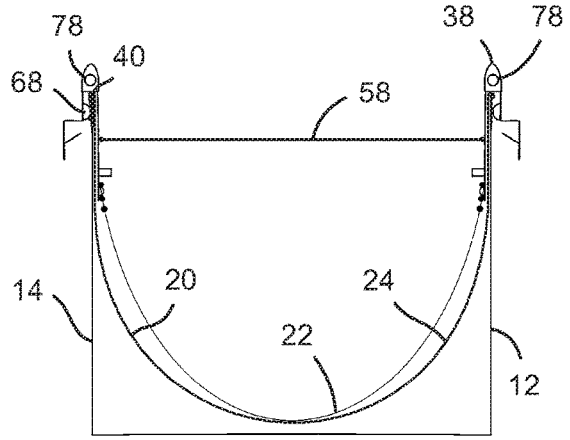

Referring to FIG. 1, the liner support member 22 may be resilient. A resilient part may be a part that flexes under the pressure of an external force but returns to its original configuration when the external force is released. The liner support member 22 may press in outward directions 66 against the interior surface 24 of the waste-receiving liner 20, thus expanding the bag. The liner support member 22 may conform the waste-receiving liner 20 to an interior shape 34 of the receptacle 16. Referring to FIG. 14, the liner support member 22 may form an arcuate shape, U shape, or other suitable shape within the liner 20.

Referring to FIGS. 1 and 14, the liner support member 22 may have a structure suitable for supporting the waste-receiving liner 20. Referring to FIG. 22, the liner support member 22 may comprise an elongate strip. Referring to FIGS. 27-29, the apparatus 10 may comprise a plurality of liner support members 22, for further example crossing one another within the waste-receiving liner 20. The members 22 may form a lattice that supports the liner to take a desired three-dimensional shape such as to conform to the inner dimensions of the waste bin.

Referring to FIGS. 1 and 27, the liner support member 22 may be secured to the top of the waste bin 12. The liner support member 22 may be secured to the waste bin 12 by being secured to the side wall 14 at a position at or adjacent the top access opening 18. The liner support member 22 may be secured to one or more of the first side 30 and the second side 50 of the side wall 14 at or near the top access opening 18 of the waste bin 12. The first side 30 and the second side 50 may be diametrically opposed to one another or positioned at other suitable locations relative to one another. In the examples shown the member or members 22 are secured at the top access opening 18.

Referring to FIG. 1, the liner support member 22 may be secured to the waste bin 12 via a suitable hook part. The hook part 38 may connect to a perimeter rim 40, for example which defines the top access opening 18, of the waste bin 12. The apparatus 10 may comprise a plurality of hook parts 38, for example with one hook part 38' securing a first end or part 42 of the liner support member 22 to a first side 30 of the side wall 14, and a second hook part 38" securing a second end or part 48 of the liner support member 22 to a second side 50 of the side wall 14. In other cases only a single part or end of the member 22 is secured.

Referring to FIGS. 27-29, the apparatus 10 may comprise a plurality of liner support members 22. In some cases such members 22 cross one another, with or without directly contacting one another, within the waste-receiving liner 20. Each liner support member 22 may be secured to the waste bin 12 via a hook part 38 or a respective plurality of hook parts 38. Referring to FIGS. 20-21 and 29, two or more liner support members 22 may be mounted to the same hook part 38.

Figure 2:
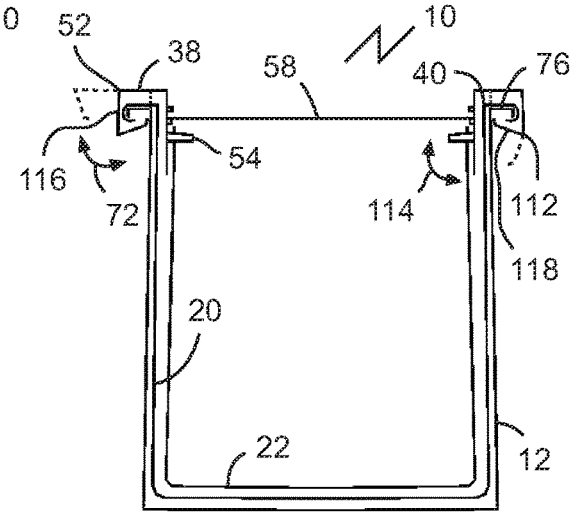

Referring to FIG. 1, the hook part 38 may have a structure suitable for mounting in various ways to perimeter rims 40 of different structures. Referring to FIGS. 2, 6, 8, and 15, the hook part 38 may extend in sequence, starting from within the receptacle, over and under the perimeter rim 40 of the waste bin 12, for example to surround a shelf or overhang 76, protrusion, hook, or other suitable part of the perimeter rim 40. Referring to FIG. 2, the hook part 38 may connect to the top perimeter rim 40 by one or more respective hinges, for example one or more of a hinge that permits a part 116 of the hook part 38 to swing or pivot in directions 72 around a pivot part 52, and/or a hinge that permits a part 118 of the hook part 38 to swing or pivot in directions 114 around a pivot part 112.

Figure 5:
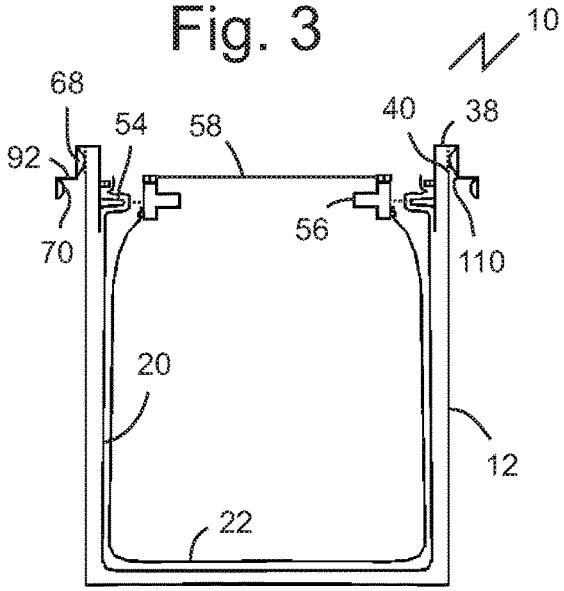
Figure 6:
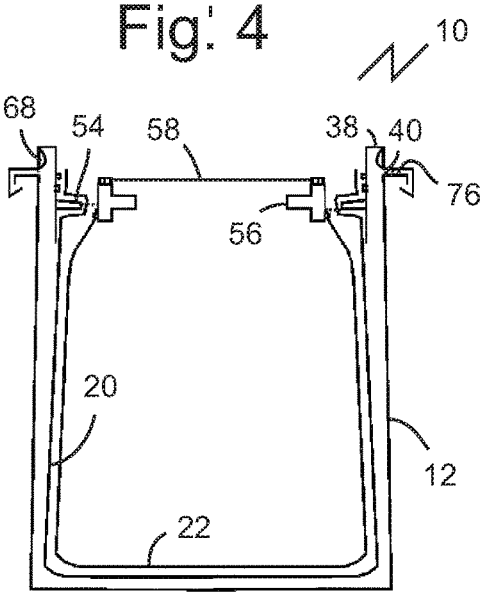

Referring to FIGS. 5, 9, 14, and 16, the hook part 38 may comprise steps or stops 92, for example with each of the stops 92 being structured to mount to a different embodiment of the perimeter rim 40. Referring to FIG. 5, the hook part 38 may comprise one or more of an inner stop 68 and an outer stop 70, for example mounted to an inside-facing surface 110 of the part 38. The stop 68 and the stop 70 may contact and/or engage the perimeter rim 40 and the overhang 76 respectively and/or limit horizontal movement of the hook part 38 in use. Referring to FIGS. 5, 9, and 10, the stops 68, 70 may facilitate the mounting of a single hook part 38 on various rims 40 of different diameters and dimensions as shown, with relatively narrower and wider rims 40 illustrated in FIGS. 5 and 10, respectively, and a shelf-less knife edge rim shown in FIG. 9. Referring to FIGS. 14-19, the hook part 38 may have a handle or finger hole 78, for example structured to facilitate manipulation of the hook part 38.

Figure 15:
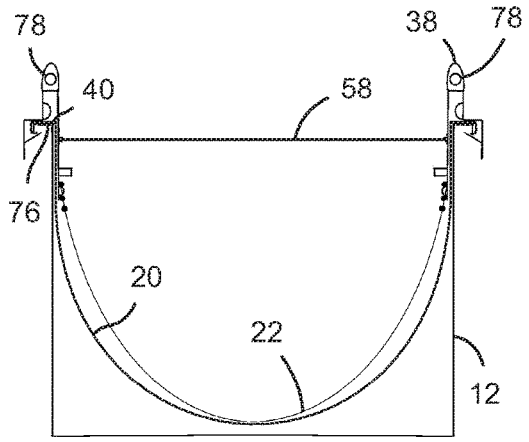
Figure 16:
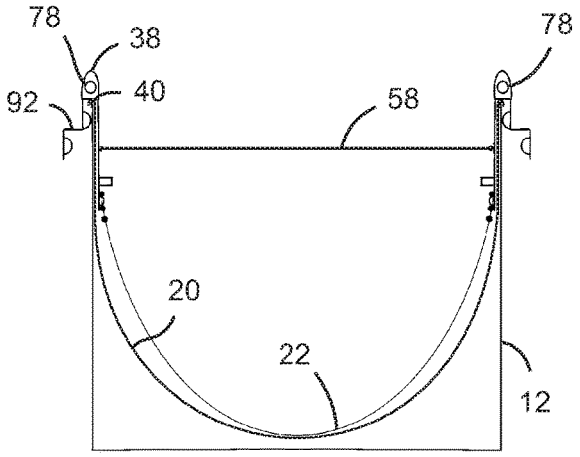
Figure 17:
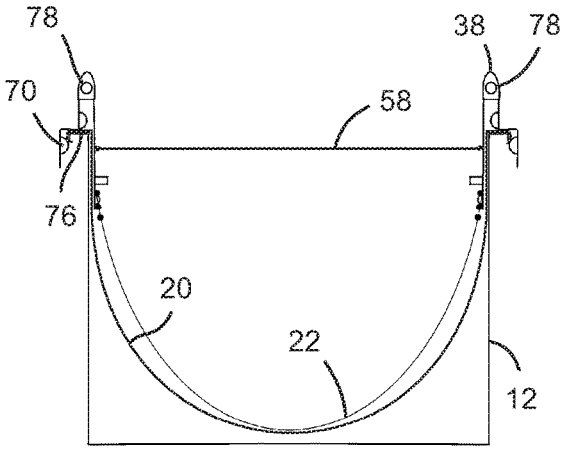
Figure 18:
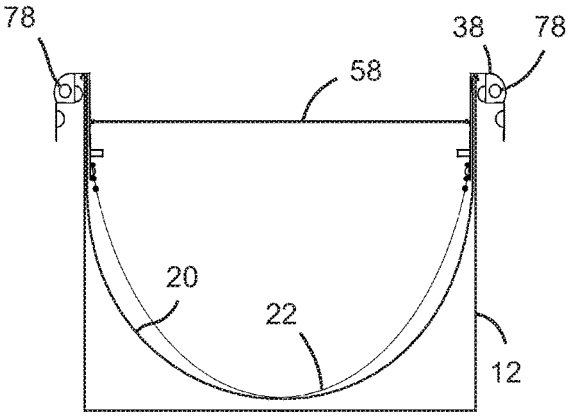
Figure 19:
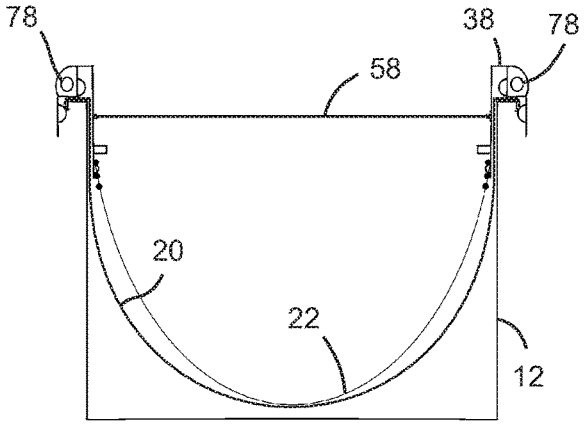

Referring to FIG. 14, the hook part 38 may have a configuration suitable for retaining the waste-receiving liner 20 within the waste bin 12. Referring to FIGS. 14-15 and 28, the hook part 38 may be positioned relative to the waste bin 12 to sandwich the waste-receiving liner 20 between the hook part 38 and the perimeter rim 40. In such a case the liner 20 may be retained between the bin 12 and part 38 by a suitable mechanism, such as a friction grip, or in other cases by use of a peg or pegs that extend into the liner. Referring to FIG. 15, the waste-receiving liner 20 may be wrapped around the overhang 76 or rim 40, for example prior to mounting the hook part 38 to the perimeter rim 40. In other cases the top of the liner 20 may extend up to or below the rim 40 within the receptacle. Referring to FIG. 17, the waste-receiving liner 20 may be wrapped around the overhang 76 and sandwiched between the overhang stop 70 of the hook part 38 and the overhang 76. Referring to FIG. 14, the waste-receiving liner 20 may be sandwiched between the stop 68 of the hook part 38 and the side wall 14 of the waste bin 12.

Figure 3:
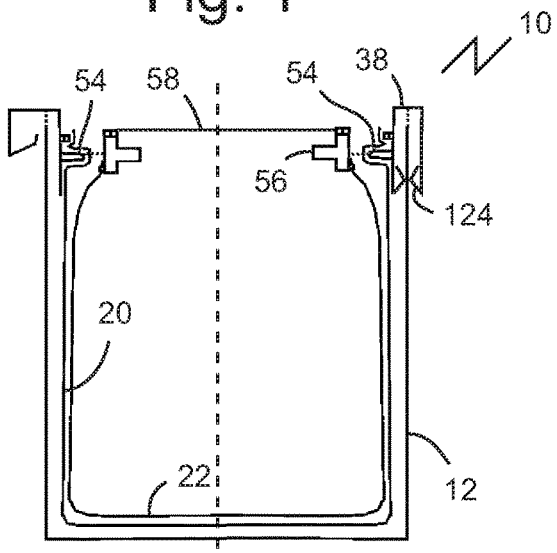
Figure 4:
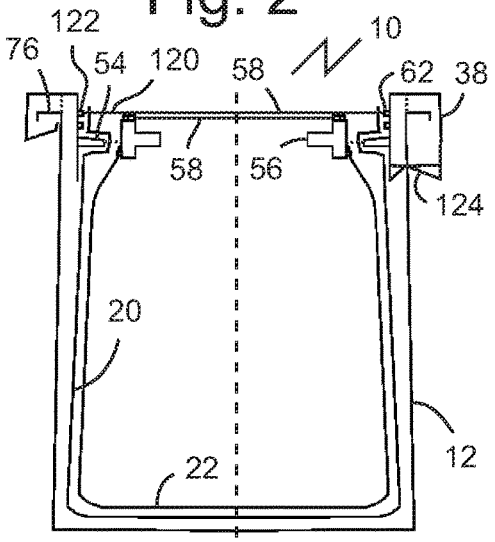

Referring to FIGS. 3-4, the hook part 38 may comprise jaws 124, for example adapted to contact or grip one or more of the waste bin 12 and the waste-receiving liner 20. The jaws 124 may have a suitable shape, with teeth that are triangular, circular, elliptical, rectangular, polygonal, symmetrical, asymmetrical, or other geometric shapes in cross section.

Referring to FIGS. 3 and 7-8, the hook part 38 may comprise or cooperate with a connector, such as a peg 54, for example which engages the waste-receiving liner 20 to support the waste-receiving liner 20. A cap 56 may engage the peg 54 to sandwich, for example even to puncture, the waste-receiving liner 20 between the cap 56 and the peg 54. Referring to FIG. 7, the cap 56 may define an indent or slot 84, for example shaped to receive the peg 54. The peg 54 and the cap 56 are an example of a male part and a female part respectively, with the male part and the female part shaped to mate with one another. The peg 54 and slot 84 of cap 56 may have suitable corresponding shapes, such as in longitudinal (shown) or axial cross section, rectangular, triangular, conical, or other suitable shapes. The cap 56 may comprise a base 56A and a protrusion 56B that extends from the base 56A. The slot 84 may extend through the base 56A and into the protrusion 56B. The cap 56 and peg 54 may cooperate to secure the two together, for example via a suitable mechanism such as a friction or snap fit, or a latch or other suitable lock. Referring to FIGS. 7 and 8 a snap fit protrusion 109 may be present on cap 56 and/or slot 84 to form a friction fit.

Referring to FIG. 27, the apparatus 10 may have a structure suitable for supporting the waste-receiving liner 20 at or adjacent the top access opening 18. The apparatus 10 may comprise a liner rim support member 58. Member 58 may be secured to the waste bin 12 and extend, along the interior surface 24 of the waste-receiving liner 20, in a circumferential direction 94 at or adjacent the top access opening 18. The reference to circumferential is not intended to be limited to elliptical, circular, and curved rims 40, and would include use on rectangular, polygonal, and other rims. The liner rim support member 58 or a plurality of liner rim support members 58 may extend around the entirety of a perimeter 128 of the waste-receiving liner 20 at or adjacent the top access opening 18. The liner rim support member 58 may conform the waste-receiving liner 20 to an interior shape 126 of the perimeter rim 40. The liner rim support member 58 may form a rounded rectangle, circle, oval, or other suitable shape. The member 58 may hold the top edges of the liner 20 up from bending back on itself into the receptacle. Referring to FIG. 1, the liner rim support member 58 may be secured to the waste bin 12 via the hook part 38. Referring to FIG. 27, the apparatus 10 may comprise two or more liner rim support members 58, for example with each liner rim support member 58 secured to the waste bin 12 via a respective plurality of hook parts 38 or the same plurality of hook parts 38. The members 58 may effectively form a tail-to-tail chain of members 58 that collectively circumnavigate the periphery of the rim 40, or plural members 58 may circumnavigate the rim 40.

Referring to FIG. 30, the apparatus 10 may comprise plural members 58, such as a first liner rim support member 58', a second liner rim support member 58", a third liner rim support member 58''', and a fourth liner rim support member 58''''. Each of the first liner rim support member 58', the second liner rim support member 58", the third liner rim support member 58''', and the fourth liner rim support member 58'''' may conform a portion of the waste-receiving liner 20 to a respective corner 130 of the waste bin 12. Each of the first liner rim support member 58', the second liner rim support member 58", the third liner rim support member 58', and the fourth liner rim support member 58'''' may be secured to the waste bin 12 via a pair of hook parts 38. Although four members 58 are illustrated, other suitable numbers of members greater or less than four may be used.

Referring to FIGS. 7 and 20-21, one or both of the liner support member 22 and the liner rim support member 58 may be secured to the waste bin 12 by securing to the peg 54, for example through the cap 56. Referring to FIG. 7, one or more of the liner support member 22 and the liner rim support member 58 may be secured to the waste bin 12 by being secured to the peg 54. Referring to FIG. 20, one or more of the liner support member 22 and the liner rim support member 58 may be secured to the waste bin 12 (FIG. 7) by being secured to the cap 56. Referring to FIG. 21, one or more of the liner support member 22 and the liner rim support member 58 may be secured to the waste bin 12 (FIG. 7) by being secured to the hook part 38. Connecting the members or one or more of them to the parts 38 via a cap 56 may be advantageous to simplify install of the members, which may be connected to the cap 56 and then the cap 56 installed in the receptacle, or the members may be installed on the cap 56 after the cap 56 is installed in the receptacle.

Referring to FIGS. 13-14, the liner support member 22 may be secured to the waste bin 12 in a fashion that permits axial length adjustment of a portion 96 of the liner support member 22 that extends along the interior surface 24 (FIG. 13) of the waste-receiving liner 20 (FIG. 13). The liner support member 22 may comprise a plurality of stops 60 that are axially spaced from one another along the liner support member 22. Referring to FIG. 21, the liner support member 22 may be secured to the waste bin 12 by a gripper part 62 that contacts a selected stop of the respective plurality of stops 60 to set an axial length of the portion 96 of the liner support member 22. The gripper part 62 may be mounted to the hook part 38, the peg 54, the cap 56, or other suitable part. Latches, friction fits, snap fits, or other suitable locking mechanisms may be used to secure the member 22 to the desired length. The length of the member 22 may be selected depending on the dimensions of the liner 20 and/or bin 12.

The liner rim support member 58 may be secured to the waste bin 12 in a fashion that permits axial length adjustment of a portion of the liner rim support member 58 that extends along the interior surface 24 of the waste-receiving liner 20. Such a fashion may be analogous to or identical to that discussed above for the liner support member 22. The liner rim support member 58 may comprise a plurality of stops 60 that are axially spaced from one another along the liner rim support member 58. The liner rim support member 58 may be secured to the waste bin 12 by a gripper part 62 that contacts a selected stop of the respective plurality of stops 60 to set an axial length of the portion of the liner rim support member 58.

Referring to FIG. 22, the stop 60 and the gripper part 62 may be structured to contact one another in a suitable fashion. Referring to FIG. 23, the gripper part 62 may comprise a protrusion 98, for example that defines a receiving channel 98A. The channel 98A may be shaped to receive an intermediate portion 100 located between adjacent stops 60 of the liner support member 22. Referring to FIG. 25, the gripper part 62 may be formed in the cap 56, for example with the gripper part 62 defining a channel 104 through ends of the cap 56. The channel 104 may be shaped to receive the intermediate portion 100. The stop 60 may have a spherical, cubic, bulbous, diamond, or other suitable shape.

Referring to FIG. 12, the gripper part 62 may be adapted to facilitate insertion and removal of the liner support member 22 into and out of the gripper part 62. The gripper part 62 may comprise opposed protrusions 106, for example that extend into a channel 108 defined by the gripper part 62. The opposed protrusions 106 may be resiliently biased into a neutral configuration, to permit the stop 60 to be inserted into the channel 108 and pushed past the opposed protrusions 106, such as in a direction 88, such that when the opposed protrusions 106 clear the stop 60 the protrusions 106 return to the neutral configuration between a pair of adjacent stops 60. Referring to FIG. 7, the channel 108 may be defined by the peg 54, the cap 56, or other suitable part.

Referring to FIG. 4, the liner support member 22 may comprise a zip tie 120 and the gripper part 62 may comprise a zip tie receiver 122. The zip tie 120 may have teeth (not shown) that engage a pawl (not shown) of the gripper part 62 to form a ratchet. The gripper part 62 may have a tab (not shown), for example that can be depressed to release the ratchet so that the zip tie 120 can be removed.

In some cases, the liner support member 22 forms a direct connection to one or more of the hook part 38, the peg 54, the cap 56, or other suitable part, without the gripper part 62. The waste bin 12 may have or lack a bottom or base, for example if the bin is open ended. The waste bin 12 may have a circular, elliptical, rectangular, polygonal, symmetrical, asymmetrical, or other geometric shape in cross section. One or more of the liner support member 22 and the liner rim support member 58 may be secured to the waste bin 12 via a clip or other suitable part. One or more of the liner support member 22 and the liner rim support member 58 may be a flexible rod. One or more of the liner support member 22 and the liner rim support member 58 may have a circular, elliptical, rectangular, polygonal, symmetrical, asymmetrical, or other geometric shape in cross section. The hook part 38 may be formed by a waste-receiving liner, for example a rigid conformal liner. In this disclosure, axial length means the length of the member between two points, for example two points adjacent respective hook parts 38, along a longitudinal axis of the member. Connections between parts, such as between the hook parts 38 and the waste bin, or between the hook parts 38 and the liner support members, may be via suitable mechanisms, such as friction fit, snap fit, pressure fit, interference fit, shark tooth fit, latches, hooks, torsional or other spring-biased device (such as a spring-biased jaw clip), and other devices.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. An apparatus comprising:

a waste bin with a side wall defining a receptacle with a top access opening;

a waste-receiving liner supported within the receptacle; and a liner support member secured to the waste bin and extending, within, and along an interior surface of, the waste-receiving liner, in a direction toward a base of the waste-receiving liner;

in which the liner support member comprises an elongate strip that is directed toward the base of the waste-receiving liner;

in which the liner support member is secured to the waste bin by being secured to the side wall at a position at or adjacent the top access opening; and in which the liner support member is secured to the waste bin using a hook part that connects to a perimeter rim, which defines the top access opening, of the waste bin.

2. The apparatus of claim 1 in which the liner support member extends along the interior surface of the waste-receiving liner from a first side of the side wall, along a base of the waste-receiving liner, and up a second side of the side wall in a direction toward the top access opening.

3. The apparatus of claim 2 in which:

the liner support member is secured to the first side of the side wall at or near the top access opening of the waste bin; and the liner support member is secured to the second side of the side wall at or near the top access opening of the waste bin.

4. The apparatus of claim 2 in which the first side and the second side are diametrically opposed to one another.

5. The apparatus of claim 2 in which the liner support member is resilient.

6. The apparatus of claim 5 in which the waste-receiving liner is a flexible bag, and the liner support member one or more of a) presses in outward directions against the interior surface of the waste-receiving liner and b) forms an arcuate shape.

7. The apparatus of claim 1 in which the liner support member conforms the waste-receiving liner to an interior shape of the receptacle.

8. The apparatus of claim 1 further comprising a plurality of hook parts, with one hook part securing a first part of the liner support member to a first side of the side wall, and a second hook part securing a second part of the liner support member to a second side of the side wall.

9. The apparatus of claim 8 further comprising a plurality of liner support members crossing one another within the waste-receiving liner, with each liner support member secured to the waste bin via a respective plurality of hook parts.

10. The apparatus of claim 1 in which the hook part extends in sequence from the receptacle, over and under the perimeter rim of the waste bin.

11. The apparatus of claim 10 in which the hook part connects to the top perimeter rim by a respective hinge.

12. The apparatus of claim 1 in which the hook part comprises a peg, which engages the waste-receiving liner to support the waste-receiving liner.

13. The apparatus of claim 12 further comprising a cap, which engages the peg to sandwich the waste-receiving liner between the cap and the peg.

14. The apparatus of claim 13 in which the liner support member is secured to the waste bin by being secured to the cap.

15. The apparatus of claim 1 in which the liner support member is secured to the waste bin in a fashion that permits axial length adjustment of a portion of the liner support member that extends along the interior surface of the waste-receiving liner.

16. The apparatus of claim 15 in which:

the liner support member comprises a plurality of stops that are axially spaced from one another along the liner support member; and the liner support member is secured to the waste bin by a gripper part that contacts a selected stop of the plurality of stops to set an axial length of the portion of the liner support member.

17. The apparatus of claim 1 further comprising a liner rim support member that is secured to the waste bin and extends, along the interior surface of the waste-receiving liner, in a circumferential direction at or adjacent the top access opening.

18. The apparatus of claim 17 in which the liner rim support member is secured to the waste bin by being secured to a part that engages the waste-receiving liner.

19. The apparatus of claim 17 in which the liner rim support member or a plurality of liner rim support members extend around the entirety of a perimeter of the waste-receiving liner at or adjacent the top access opening.

20. The apparatus of claim 17 in which the liner rim support member is secured to the waste bin in a fashion that permits axial length adjustment of a portion of the liner rim support member that extends along the interior surface of the waste-receiving liner.

21. The apparatus of claim 20 in which:

the liner rim support member comprises a plurality of stops that are axially spaced from one another along the liner rim support member; and the liner rim support member is secured to the waste bin by a gripper part that contacts a selected stop of the plurality of stops to set an axial length of the portion of the liner rim support member.

22. A method comprising:

inserting a waste-receiving liner into a receptacle of a waste bin;

inserting a liner support member to extend within, and along an interior surface of, the waste-receiving liner, in a direction toward a base of the waste-receiving liner; and securing the liner support member to the waste bin;

in which the liner support member comprises an elongate strip that is directed toward the base of the waste-receiving liner;

in which the liner support member is secured to the waste bin by being secured to the side wall at a position at or adjacent the top access opening; and in which the liner support member is secured to the waste bin using a hook part that connects to a perimeter rim, which defines the top access opening, of the waste bin.

23. The apparatus of claim 1 in which the liner support member is structured to maintain the waste-receiving liner in an open position and retain the waste-receiving liner within the waste bin when the apparatus is in an upside down position.

24. The method of claim 22 in which the liner support member is structured to maintain the waste-receiving liner in an open position and retain the waste-receiving liner within the waste bin when the apparatus is in an upside down position.

* * * * *